US006239817B1

(12) United States Patent
Meyer

(10) Patent No.: US 6,239,817 B1
(45) Date of Patent: May 29, 2001

(54) APPARATUS AND METHOD FOR PRINTING BORDERLESS PRINT IMAGE

(75) Inventor: David R. Meyer, Escondido, CA (US)

(73) Assignee: Hewlett-Packard Comapny, Palo Alto, CA (US)

( * ) Notice: Subject to any disclaimer, the term of this patent is extended or adjusted under 35 U.S.C. 154(b) by 0 days.

(21) Appl. No.: 09/175,818

(22) Filed: Oct. 20, 1998

(51) Int. Cl.[7] ..... B41J 2/165; B41J 29/38
(52) U.S. Cl. ..... 347/36; 347/16
(58) Field of Search ..... 347/8, 36, 35, 347/31, 103, 16; 101/419, 420; 400/642, 646

(56) References Cited

U.S. PATENT DOCUMENTS

| | | | | |
|---|---|---|---|---|
| 4,701,771 | | 10/1987 | Ikeda | 347/36 |
| 4,975,780 | | 12/1990 | Kuboki | 358/296 |
| 5,192,141 | | 3/1993 | Chung et al. | 400/56 |
| 5,291,227 | * | 3/1994 | Suzuki | 347/36 |
| 5,393,151 | | 2/1995 | Martin et al. | 440/642 |
| 5,510,815 | | 4/1996 | Linder et al. | 347/6 |
| 5,517,222 | | 5/1996 | Sugiyama et al. | 347/35 |
| 5,571,587 | | 11/1996 | Bishop et al. | 428/43 |
| 5,627,571 | | 5/1997 | Anderson et al. | 347/19 |
| 5,659,342 | | 8/1997 | Lund et al. | 347/35 |
| 5,677,719 | | 10/1997 | Granzow | 347/103 |
| 5,686,944 | | 11/1997 | Takagi et al. | 347/41 |
| 5,719,602 | | 2/1998 | Hackleman et al. | 347/14 |
| 5,771,052 | | 6/1998 | Hine et al. | 347/42 |
| 5,997,129 | * | 12/1999 | Matsuhashi | 347/35 |

* cited by examiner

*Primary Examiner*—Thinh Nguyen
(74) *Attorney, Agent, or Firm*—Jerry R. Potts

(57) ABSTRACT

A borderless inkjet printer includes a hollow open end platen having a block of ink absorbent material disposed there within and exposed to a plurality of inkjet cartridges. A front set and a rear set of upstanding cockle ribs extend upwardly from the platen a sufficient distance to substantially prevent either a leading edge and a trailing edge of a sheet of print medium travel across a print zone within the printer from making contact with the absorbent material. A print engine having at least one print head travels in a rectilinear path above the print zone to eject ink droplets onto edge portions of the print medium to provide a borderless print image thereon.

16 Claims, 4 Drawing Sheets

APPARATUS AND METHOD FOR PRINTING BORDERLESS PRINT IMAGE

TECHNICAL FIELD

The present invention relates in general to a method and apparatus for printing images. The invention more particularly relates to a method and apparatus for printing borderless print images.

BACKGROUND ART

Conventional inkjet print engines contain three primary components which are generally organized in series. These components are a platen located in a print zone, a spittoon in which excess print drops are collected, and a service station which receives a print carriage unit and its associated inkjet cartridges for helping to extend the life of the cartridges by wiping and capping them when they are not in use.

In a conventional inkjet carriage unit there may be mounted removably therein one or more ink cartridges or print heads. The carriage unit is adapted to sweep the ink cartridges in a path of travel above a medium sheet that is moved in an orthogonal direction to the carriage unit. As the print heads sweep above the medium, they eject droplets of ink downwardly onto the medium sheet which is supported from below by the platen.

In order to avoid the smearing of ink on the underside of a medium sheet, the conventional print engine will prevent the ejection of ink onto the leading, trailing, and side edge portions of the medium sheet. In this manner, sheet margins are created on the medium sheet, which in turn protect the upper surface of the supporting platen from the ink droplets being ejected by the print head.

While the printing of images with borders has been satisfactory for most applications, with the advent of photo printers and the like there has been a desire to print borderless images.

One attempt at seeking to provide a user with border and borderless print images has been to print images on medium stock with perforated tabs. With this arrangement if a user desired a borderless print, the user would merely separate the perforated tab from the remaining portion of the medium stock carrying the print image. In order to avoid tearing the medium stock carrying the print image most users would utilize a trimming device to separate the tab from the stock.

While the utilization of perforated medium stock in an inkjet printer may provide borderless print images, the use of such medium stock is expensive and may result in a valuable image being torn when a trimming device is unavailable or not used.

Therefore it would be highly desirable to have a new and improved inkjet printer that produces borderless print images without the need of utilizing a special trimming device or perforated medium stock.

DISCLOSURE OF THE INVENTION

The present invention solves the problem of borderless printing by providing a new and improved inkjet printer that prints edge to edge prints. The new and improved inkjet printer includes housing for supporting a moveable carriage unit that transports at least one print head cartridge along a rectilinear path of travel between a maintenance area and a printing area. A platen and associated drive mechanism is mounted within a print zone area within the housing. The platen has a floor bounded at its outer periphery by an upstanding wall terminating in a lip that defines a hallowed out support area for receiving a sheet of ink absorbent material. A paired set of spaced apart cockle ribs are disposed on opposite sides of two of the platen walls, a front wall member and a rear wall member that help define the print zone area within the printer. One set of the cockle ribs support from below the front or leading portion of a sheet of print medium as it passes into the print zone area of the printer. The other set of cockle ribs support from below the rear or trailing portion of the print medium as it is leaving the print zone area. A controller mounted within the housing coordinates the sweeping motion of the carriage unit between the print zone area and the maintenance area with the firing of the inkjet print head cartridge nozzles to overprint beyond the outer peripheral boundary areas of the medium sheet.

BRIEF DESCRIPTION OF DRAWINGS

The above mentioned features of this invention and the manner of attaining them will become apparent, and the invention itself will be best understood by reference to the following description of the embodiment of the invention in conjunction with the accompanying drawings, wherein.

PREFERRED EMBODIMENT OF THE PRESENT INVENTION

Figure 1:
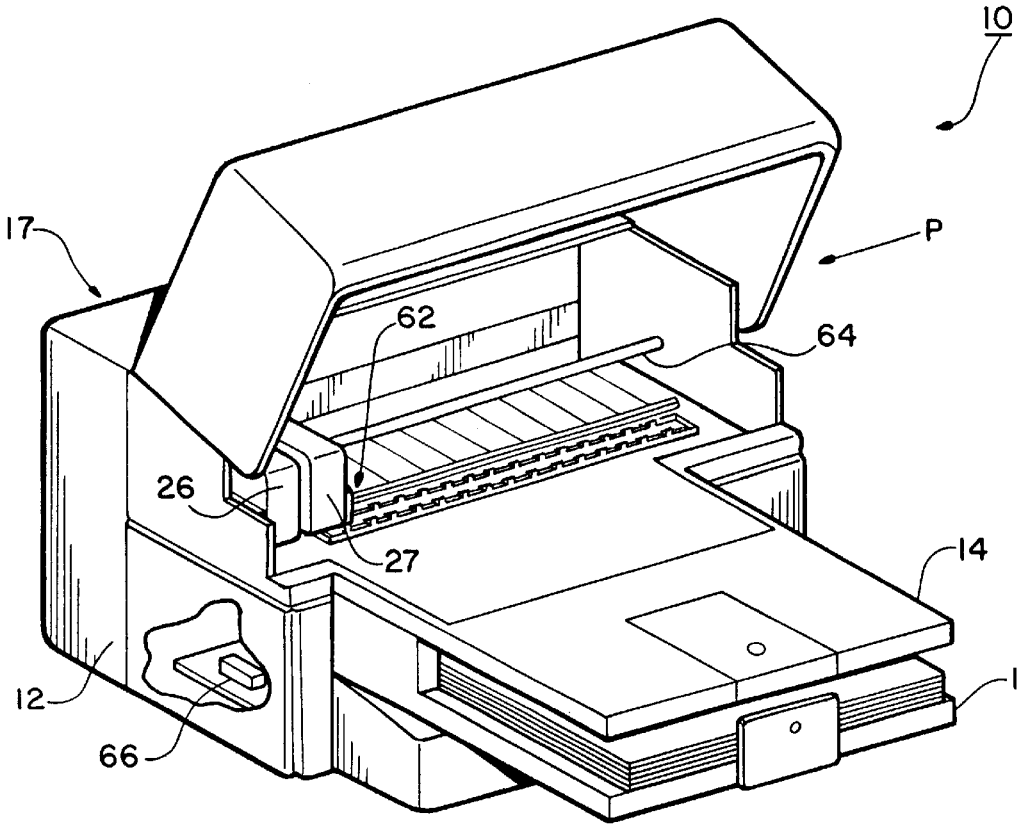
FIG. 1 is a perspective view of a borderless inkjet printer which is constructed in accordance with the present invention.

Referring now to the drawings, and more particularly to FIG. 1 thereof, there is shown a borderless inkjet printer 10 which is constructed in accordance with the present invention. The borderless inkjet printer 10 provides for both bordered and borderless print images on conventional medium sheets without the necessity of utilizing special trimmers or perforated medium stock except for bottom edge portions as will be explained hereinafter in greater detail. In accordance with the novel method of overprinting the boundary edge portions of medium sheets, borderless print images are provided in a fast and convenient manner.

The borderless inkjet printer 10, includes a housing 12 having mounted therein a medium output tray 14 for receiving and temporarily storing individual sheets of medium, such as a medium sheet 16, that has passed through a print zone 18 within the printer 10. As will be explained hereinafter in greater detail, an upper paper guide 28 and associated drive mechanism 20 supports and pulls the medium sheet 16 across the print zone 18. A hollowed platen 30 having a front set 35 of cockle ribs and a rear set 37 of cockle ribs support the medium sheet 16 from below as it travels across the print zone 18.

Figure 2:
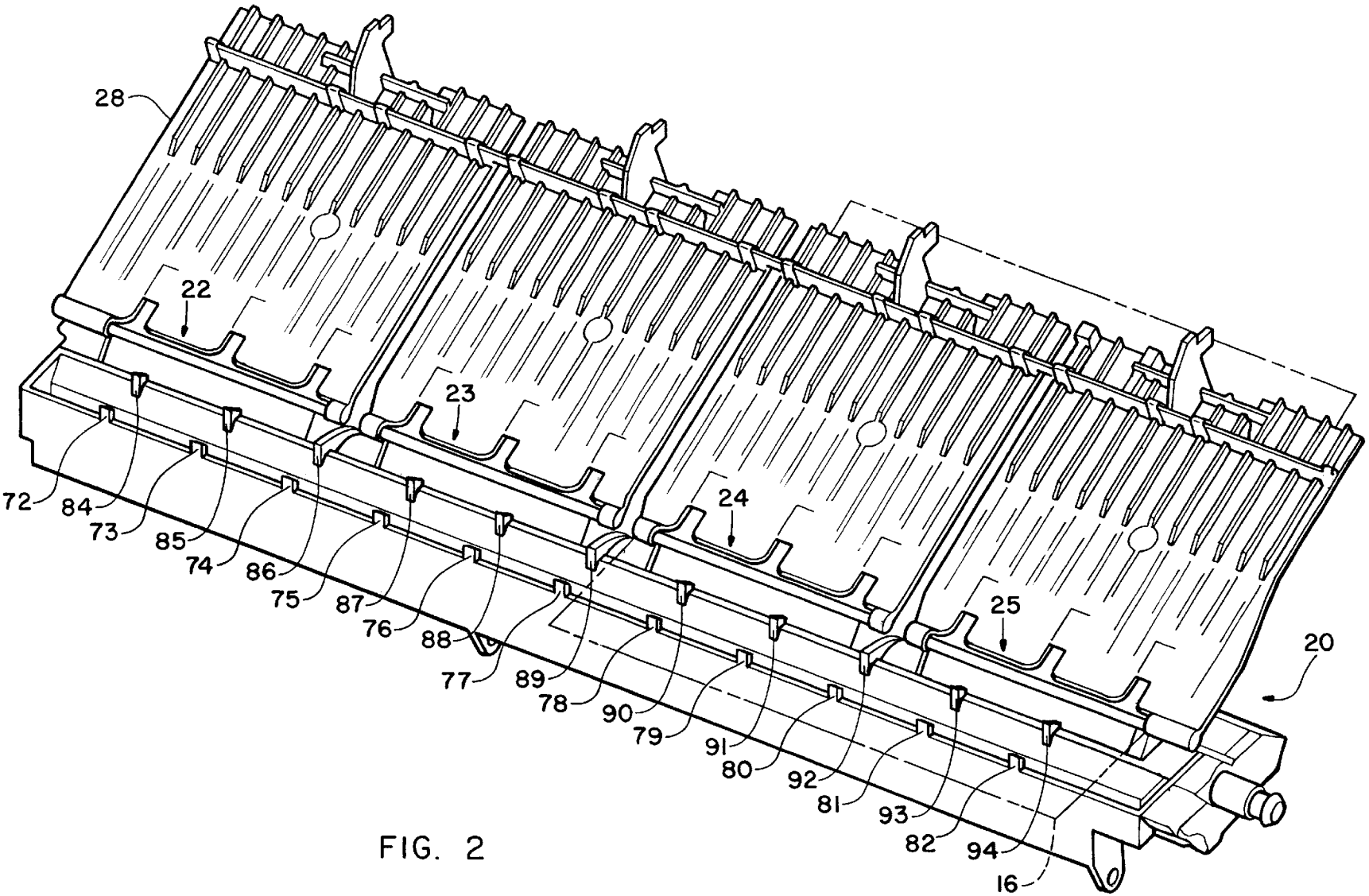
FIG. 2 is perspective view of a platen mounted within a print zone area of the inkjet printer of FIG. 1 illustrating its associated upper paper guide and drive mechanism.

As best seen in FIG. 2, the platen 30 is mounted within the print zone 18 and has a floor 32 that is bounded at its outer periphery by an upstanding wall 34. The upstanding wall 34 terminates in a lip, indicated generally at 36, that defines a hallowed out support area 38 that is dimensioned for receiving a thick sheet 40 of ink absorbent material. The sheet 40 of ink absorbent material 40 is generally blocked shaped having a height that extends to upper boundary surface area of the wall lip 36. The front set 35 and rear set 37 of cockle ribs extend sufficiently above the lip 36 and the absorbent material 40 to support from below a medium sheet as it passes below a print engine 60 mounted within the housing 12.

The print engine 60 is a conventional inkjet print engine that includes a carriage unit 62 mounted moveable on a slider rod 64. The carriage unit 62 moves along the slider rod 64 under the coordinated control of a controller 66 traveling back and forth on a rectilinear path of travel (P) from a maintenance area, indicated generally at 17 into and out of the print zone area 18. The carriage unit 62 holding one or more print head cartridges, such as the print head cartridges 26–27.

As will be explained hereinafter in greater detail, the controller 66 that is mounted within the housing 12, coordinates the sweeping motion of the carriage unit 62 between the maintenance area 17 and the print area 18 with the firing of the nozzles in the inkjet print head cartridges 26–27 to overprint beyond the outer peripheral boundary areas of the medium sheet 16.

In operation, the print engine 60 has two primary modes of operation: a margin mode and a borderless mode. As the margin mode of operation is conventional and well known to those skilled in the art, the details of the operating steps will not be described hereinafter in greater detail.

Figure 6:
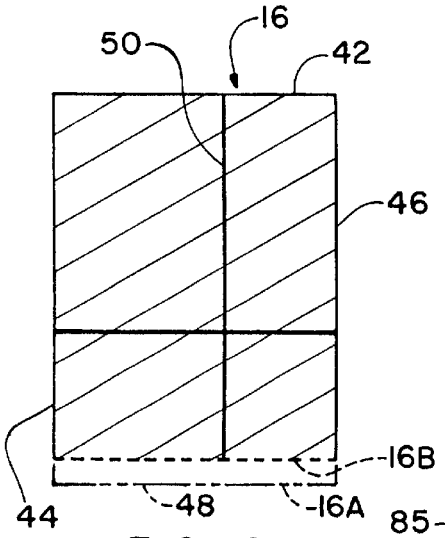
FIG. 6 is a diagrammatic illustration of a sheet of print medium printed edge to edge in accordance with the method of the present invention.

Considering now the borderless mode of operation in greater detail with reference to FIGS. 4A–C and FIG. 5, in the borderless mode of operation, the print engine 60 causes a medium sheet, such as the medium sheet 16, to be retrieved from the input tray 13. As best seen in FIG. 6, the medium sheet 16 has outer boundary edges at 42, 44, 46 and 48 and includes a tear off portion 16A that is separable from the remainder of the medium sheet 16 by a tear off perforated line 16B. Thus, when the tear off portion 16A is separated from the sheet 16, the sheet 16 acquires a new boundary edge indicated at 16B.

Figure 4B:
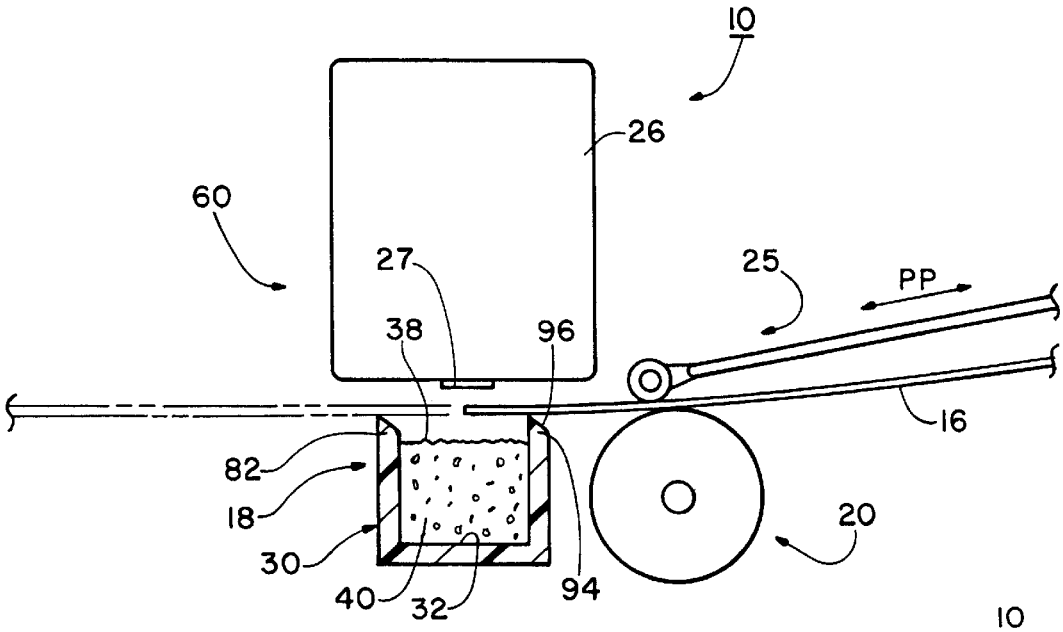
FIGS. 4A–C illustrate the steps of overprint a sheet of print medium to provide a full edge to edge image prepared in accordance with the present invention.
Figure 4A:
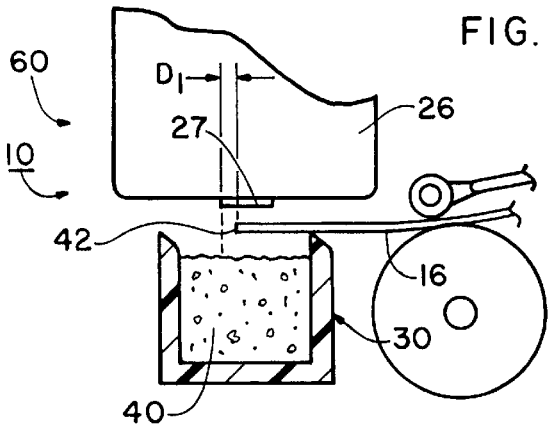
Figure 4C:
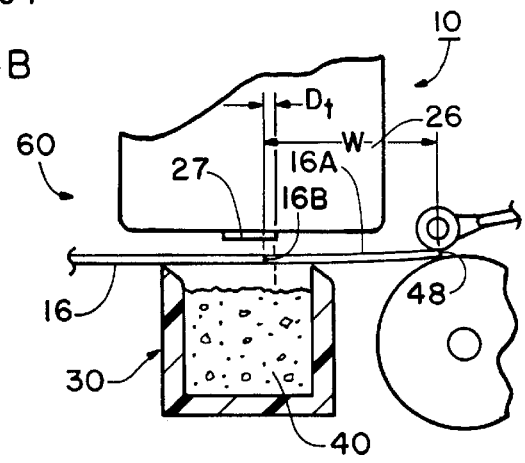

In order to move the medium sheet 16 from the input tray 13, the sheet 16 is engaged by a medium drive mechanism 20 that pulls the medium sheet 16 into the paper path of the printer 10. The medium drive mechanism 20 directs the medium sheet 16 along a paper path of travel (PP) through the print zone area 18 and into the output tray 14. As the medium sheet 16 passes through the print zone area 18, the controller 66 causes at least one of the print head cartridges 26–27 to over spray the medium sheet 16 along its respective leading edge 42 (FIG. 4A) and side edges 44, 46 (FIG. 4B) by about a distance $D_l$, where the distance $D_l$ is about 2 millimeters. As best seen in FIGS. 4C and 6, a trailing edge portion of the print medium sheet 16 includes the tear off 16A that has a length dimension of about W millimeters. The length W is sufficient to permit the tear portion 16A to be controlled by the drive rollers of the drive mechanism 20. The perforated tear line 16B facilitates printing to the edge of the tear line 16B. The sheet 16 is oversprayed by about a distance $D_t$ relative to the edge of the tear line 16B, in order to provide an edge to edge or borderless print 50 (FIG. 6) when the tear off portion 16A is removed from the remaining portion of the print medium sheet. The distance $D_t$ is about 2 millimeters.

In order to prevent the underside of the medium sheet 16 from picking up any residual ink, the medium sheet 16 is supported from below by the front and rear sets 35, 37 of cockle ribs which are sufficiently spaced from the ink absorbent sheet 40 to prevent contact therewith. In this regard, the over spray of ink droplets from the cartridges 26–27 falls directly onto the ink absorbent sheet 40 and is wicked into its interior and away from its surface. Thus such residual ink accumulated by the sheet 40 is prevented from making contact with the underside of the medium sheet 16.

Figure 3:
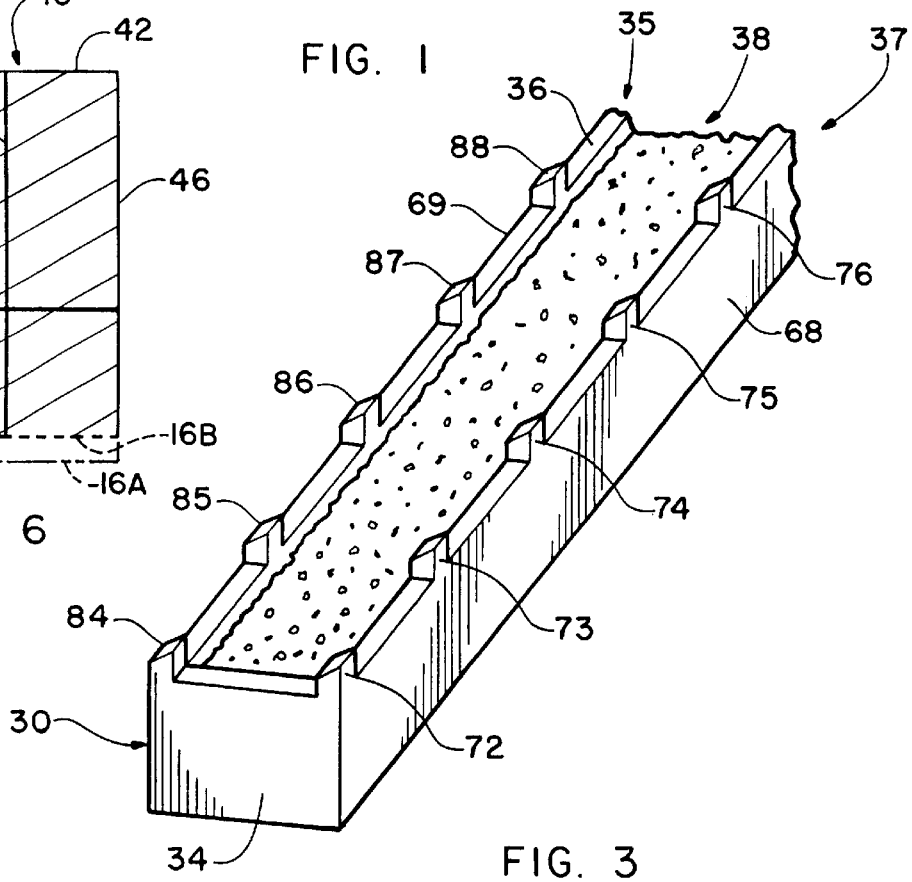
FIG. 3 is another perspective view of the platen illustrating it without the associated upper paper guide and drive mechanism of FIG. 2.
Figure 5:
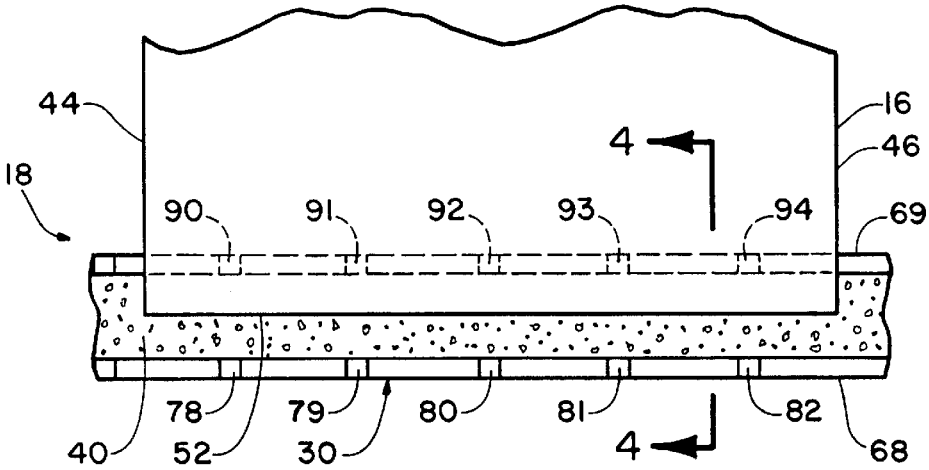
FIG. 5 is a diagrammatic top plan view of the platen of FIG. 2, illustrating the sheet of print medium as it passes through the print zone.

Considering now the platen 30 in greater detail with reference to FIGS. 2–3 and 5, the platen 30 is mounted adjacent the drive mechanism 20 and a upper paper guide 28 that facilitate the transporting of the print medium sheet 16 into the print zone area 18. As best seen in FIG. 4A, as the print medium sheet 16 approaches the print zone area 18, the front set 35 of cockle ribs engage the leading edge 42 causing it to slide along their front surfaces, such as a front surface 96 and onto the top peak portion of each cockle rib within the set 35. As the drive mechanism continues to advance the sheet 16 overlays the front set 35 of cockle ribs protecting them from any over spray from the print heads 26–27 as the sheet 16 is supported from below. The controller 66 stops the sheet 16 as it travels along the paper path (PP) so that the leading edge of the sheet 16 is positioned to facilitate front and side edge image printing as best seen in FIGS. 4A and 4B. Thereafter, as the sheet 16 is advanced along its path of travel, the sheet arrives at a position as illustrated in FIG. 4C where the rear portion of the sheet 16 is supported from below by the rear set 37 of cockle ribs. The controller 66 stops the sheet 16 at the position illustrated in FIG. 4C for example, so that the rear edge portion of the sheet 16 can be sprayed up to the leading edge of the tear off 16A to provide the edge to edge image 50 once the perforated tear off 16A is separated from the sheet.

Considering now the front set 35 of cockle ribs in greater detail with reference to FIGS. 2–5, the front set 35 of cockle ribs includes a plurality of equally spaced apart upstanding cockle ribs 84–94. In a like manner, the rear set 37 of cockle ribs includes a plurality of equally spaced apart upstanding cockle ribs 72–82. The front set 35 of cockle ribs 84–94 are diametrically opposite the rear set 37 of cockle ribs 72–82. The distance between the front set 35 and the rear set 37 of cockle ribs is selected so that any type of print medium sheet can be sufficiently supported from below by the rear set 37 to reach the front set 35 of cockle ribs without the leading edge of the sheet 16 making contact with the absorbent material. In a like manner, the distance is further selected so that the trailing edge of the print medium sheet does not make contact with the absorbent material 40 after it is no longer supported by the rear set of cockle ribs 84–94. While this is the preferred configuration for the sets of cockle ribs, those skilled in the art will understand that other configurations are contemplated within the true scope of the present invention. Thus for example, the cockle ribs may be unequally spaced in a given set, such as in set 35 or alternately, the cockle ribs in the respective front and rear sets 35, 37 may be offset from one another.

Considering now the cockle ribs 72–82 and 84–94 in greater detail with reference to FIGS. 2 and 4, the cockle ribs 72–82 and 84–94 are substantially identical to one another so only cockle rib 94 will be described hereinafter in greater detail. In this regard, the cockle rib 94 is integrally connected to the upstanding wall 34 and extends upwardly therefrom a sufficient distance to prevent the print medium sheet 16 from making contact with the absorbent block 40. The cockle rib 94 has a block like base and a tapered top 96 that slants upwardly in a direction opposite of the path of travel followed by the print medium as it enters the print zone 18. The upward slanting of the rib 94 is an important features as it facilitates the lifting of the leading edge of the sheet 16 onto the top peak of the rib so that the sheet is disposed at a maximum distance from the absorbent material 40 relative to the over all height of the rib 94.

TABLE I

| Material Type | Thickness | Number of Sheets In Life Cycle | Number Printed Before Failure | Type of Observable Failure (Identified Cause of Failure) |
|---|---|---|---|---|
| Sample #1 Cotton Fiber Absorbent Ahlstrom Grade: 320 100% cotton fiber Basis Weight: 720 g/m$^2$ Flow Rate: 220 ml/min Wet Burst: 20 in $H_2O$ Capillary Rise: 79 mm in one minute | Unknown | 6000 | 4000 | Small specks of ink stuck to backside of sheet. Specks can be easily brushed off without smearing the underside of the medium. (Whiskers of ink build up from top surface of absorbent material and break off sticking to underside of medium.) |
| Sample #2 POREX Technologies X-4894 medium sheet 45–90$\mu$ without surfactant | Unknown | 6000 | 4500 | Small amount of ink transferred to the backside of the medium in the shape of small spots. (Ink build up from surface of the absorbent material is sufficient to make contact with the underside of the medium.) |
| Sample #3 Same as Sample #2 | Unknown | 6000 | 5000 | Small amount of ink transferred to the backside of the medium in the shape of a line. (Ink build up from the surface of the absorbent material is sufficient to make contact with the underside thereof.) |

To verify the reliability of the printer 10, a series of simultaneous test were conducted printing the same set of print images but using different type of ink absorbent materials and different thickness of material. Table I summaries the results of the various tests.

Figure 7:
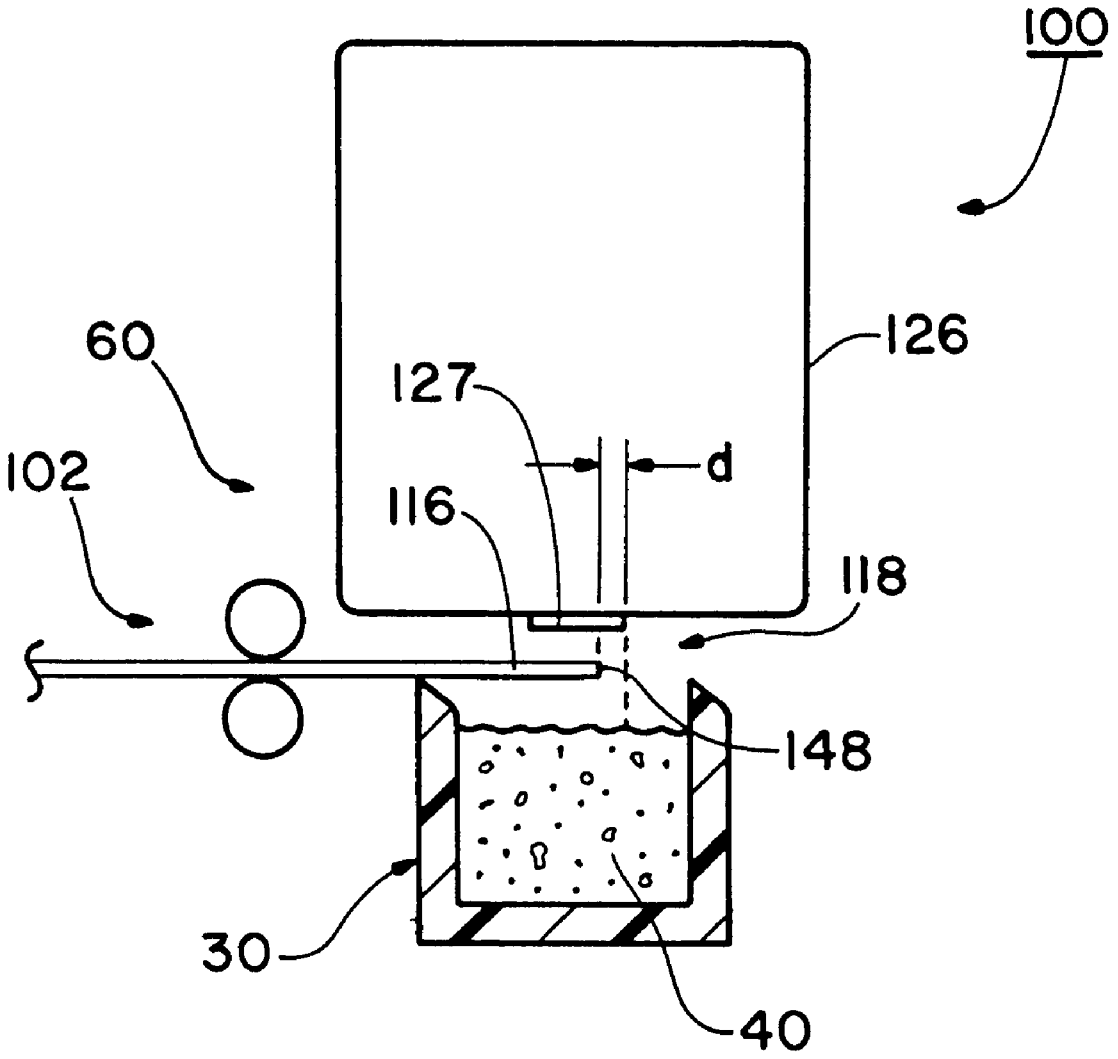
FIG. 7 is a diagrammatic view of another borderless printer which is constructed in accordance with the present invention.

Referring now to FIG. 7 there is shown a borderless inkjet printer 100 which is constructed in accordance with the present invention. The borderless inkjet printer 100 is substantially similar to the printer 10 except that it provides for both bordered and borderless print images on conventional medium sheets without the necessity of utilizing special sheet cutters or perforated medium stock. In short, no trailing edge tear off medium sheet is required.

In order to accomplish edge to edge printing the printer 100 further includes a front set of motor driven drive rollers 102 that help move a print medium sheet 116 along a path of travel from a print zone 118 into an output tray, such as the output tray 14.

The operation of the printer 100 is substantially similar to printer 10 except the drive rollers 102 advance the sheet 116 into the print zone 118 a sufficient distance to permit a trailing edge 148 of the sheet to be oversprayed by the inkjet nozzles 127 of the print head 126. As best seen in FIG. 7, the nozzle 127 oversprays the trailing edge 148 by about a distance d, where d is about 2 millimeters. It should be understood by those skilled in the art that the distance d can be less or greater than 2 millimeters depending upon the size and paper weight of the particular print medium handled by the printer 100.

While particular embodiments of the present invention has been disclosed, it is to be understood that various different modifications are possible and are contemplated within the true spirit and scope of the appended claims. Thus, for example, the cockle ribs could be more closely spaced apart in the lateral direction. Alternately, the sets of cockle ribs could extend upwardly from the floor of the platen to be more closely space apart in their other direction. In this configuration, rib extending holes would be necessary in the absorbent material. Finally, a combination of cockle ribs could be provided where some extend from the wall lip while others extend from the platen floor. In any event, it should be recognized by those skilled in the art that placement of the cockle ribs on the floor area necessarily would limit the available over spray area that would be required to prevent the over spray from contaminating the uncovered ribs. From the foregoing, there is no intention, therefore, of limitation to the exact abstract or disclosure herein presented.

I claim:

1. A borderless inkjet printer, comprising:

a hollow platen having a set of walls for defining an unobstructed ink receiving opening, said opening terminating in a lip for helping to define an unobstructed print zone for receiving ejected ink droplets;

a block of ink absorbent material received through said unobstructed ink receiving opening and disposed within said unobstructed print zone for absorbing ejected droplets of ink;

a front set and rear set of opposing spaced apart upstanding cockle ribs extending upwardly from the lip of said hollow platen;

said cockle ribs being disposed a sufficient distance outside of said print zone to substantially prevent their contact with the droplets of ink ejected into said print zone; and a printhead traveling in said print zone to eject ink droplets into said print zone and onto leading and trailing edge portions of a sheet of print medium to provide a borderless print image thereon.

2. A borderless inkjet printer according to claim 1, wherein said front set of upstanding cockle ribs are equally spaced apart.

3. A borderless inkjet printer according to claim 2, wherein said rear set of upstanding cockle ribs are equally spaced apart.

4. A borderless inkjet printer according to claim 3, wherein said front set of cockle ribs and said rear set of cockle ribs are diametrically opposite one another on opposite sides of said platen.

5. A borderless inkjet printer according to claim 4, wherein said front cockle ribs and said rear cockle ribs are spaced sufficiently closed together to substantially prevent a center portion of the print medium sheet from making contact with said absorbent material but not sufficiently close together to permit leading edge over sprays from contaminating the front cockle ribs with ejected ink.

6. A borderless inkjet printer according to claim 5, wherein said front cockle ribs and said rear cockle ribs are further spaced sufficiently close together to substantially prevent either a leading edge portion and a trailing edge portion from making contact with said absorbent material.

7. An inkjet printer platen for facilitating borderless printing on a sheet of print medium traveling across an unobstructed print zone for edge to edge printing purposes, comprising:

a platen housing having a wall for defining an unobstructed ink absorbent receiving area;

a block of ink absorbent material configured to be freely received within said unobstructed ink absorbent receiving area to facilitate edge to edge image printing on the sheet of print medium;

a front set and a rear set of upstanding cockle ribs integrally connected to an upper lip surface of said wall and extending upwardly therefrom a sufficient distance to substantially prevent a leading edge of the sheet of print medium from making contact with the upper lip surface of said wall as said sheet travels along a path of travel across the unobstructed print zone and to substantially prevent a trailing edge of the sheet of print medium from making contact with said upper lip surface of said wall as said sheet travels along the path of travel across the unobstructed print zone; and a print engine having at least one print head traveling in said print zone for causing ink droplets to be ejected onto edge portions of the print medium and not onto either set of the upstanding cockle ribs to provide a borderless print image thereon.

8. An inkjet printer platen according to claim 7, wherein said front set of upstanding cockle ribs are equally spaced apart.

9. An inkjet printer platen according to claim 8, wherein said rear set of upstanding cockle ribs are equally spaced apart.

10. An inkjet printer platen according to claim 9, wherein said front set of cockle ribs and said rear set of cockle ribs are diametrically opposite another on opposite sides of said platen.

11. An inkjet printer platen according to claim 10, wherein said front cockle ribs and said rear cockle ribs are spaced sufficiently closed together to substantially prevent a center portion of the print medium sheet from making contact with said absorbent material but not sufficiently close together to permit leading edge over sprays from contaminating the front cockle ribs with ejected ink.

12. An inkjet printer platen according to claim 11, wherein said front cockle ribs and said rear cockle ribs are further spaced sufficiently closed together to substantially prevent either a leading edge portion and a trailing edge portion from making contact with said absorbent material.

13. A method of edge to edge printing with an inkjet printer, comprising:

supporting from below with a front set of upstanding cockle ribs and a rear set of upstanding cockle ribs a sheet of print medium as it travels across a print zone area within the inkjet printer;

moving a front edge portion of the sheet of print medium a sufficient distance into said print zone area to overlay said rear set of cockle ribs to protect them from an ejecting ink over spray but not a sufficient distance into said print zone area to allow said ejecting ink over spray to contaminate said front set of cockle ribs;

over spraying said front edge portion of the sheet of print medium with ink to provide a front edge image on the print medium sheet;

moving a rear edge portion of the sheet of print medium a sufficient distance into said print zone area to overlay said front set of cockle ribs to protect them from said ejecting ink over spray but not a sufficient distance into the print zone area to allow the trailing edge of said print medium sheet to make contact with said block of ink absorbent material;

over spraying said rear edge portion of the sheet of print medium with ink to provide a rear edge image on the print medium sheet; and ejecting the print medium sheet from said print zone area.

14. A method of edge to edge printing with an inkjet printer, according to claim 13 further comprising:

over spraying a right side edge portion and a left side edge portion of said print medium sheet with ink to provide an edge to edge print image on the print medium sheet.

15. A method of edge to edge printing with an inkjet printer according to claim 14, wherein said step of supporting from below includes:

engaging each individual cockle rib in said rear set of cockle ribs substantially simultaneously with a leading edge of the print medium sheet;

sliding said leading edge upwardly along a tapered surface of each individual cockle rib in said rear set of cockle ribs until said leading edge is supported from below by a peak supporting surface of each cockle rib in said rear set of cockle ribs; and moving said print medium sheet along the peak supporting surface of each cockle rib in said rear set of cockle ribs a sufficient distance to overlay said peaks to prevent them from being contaminated with ink over spray.

16. An inkjet printer, comprising:

a platen for helping to define a print zone, said print zone having sufficient width and length dimensions to facilitate borderless printing on a sheet of print medium;

a front edge drive control roller for transporting a front edge portion of the sheet of print medium a sufficient distance into said print zone area to overlay a set of cockle ribs to protect them from an ejecting ink over spray but not a sufficient distance into said print zone area to allow said ejecting ink over spray to contaminate another set of cockle ribs so that over spraying said front edge portion of the sheet of print medium with ink provides a front edge image on the print medium sheet; and a rear edge drive control roller for transporting a rear edge portion of the sheet of print medium a sufficient distance within said print zone area to overlay said another set of cockle ribs to protect them from ejecting ink over spray but not a sufficient distance within said print zone area to allow said ejecting ink over spray to contaminate said set of cockle ribs so that over spraying said rear edge portion of the sheet of print medium with ink provides a rear edge image on the print medium sheet.

* * * * *